US012747738B2

(12) United States Patent
Cho et al.

(10) Patent No.: US 12,747,738 B2
(45) Date of Patent: Sep. 29, 2026

(54) BLOWING DEVICE AND BLOWING DEVICE OPERATING METHOD

(71) Applicant: SAMSUNG ELECTRONICS CO., LTD., Suwon-si (KR)

(72) Inventors: Mingi Cho, Suwon-si (KR); Doyoung Kim, Suwon-si (KR); Wooseog Song, Suwon-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 0 days.

(21) Appl. No.: 18/775,888

(22) Filed: Jul. 17, 2024

(65) Prior Publication Data

US 2024/0369070 A1 Nov. 7, 2024

Related U.S. Application Data

(63) Continuation of application No. PCT/KR2022/019685, filed on Dec. 6, 2022.

(30) Foreign Application Priority Data

Jan. 27, 2022 (KR) ..... 10-2022-0012581

(51) Int. Cl.
*F04D 29/54* (2006.01)
*F04D 29/70* (2006.01)
(Continued)

(52) U.S. Cl.
CPC ..... *F04D 29/541* (2013.01); *F04D 29/703* (2013.01); *F04D 25/10* (2013.01);
(Continued)

(58) Field of Classification Search
CPC .... F04D 29/462; F04D 29/464; F04D 29/563; F04D 29/703; F04D 27/002;
(Continued)

(56) References Cited

U.S. PATENT DOCUMENTS 8,784,071 B2 7/2014 Gammack
2017/0353095 A1 12/2017 Keil et al.
(Continued)

FOREIGN PATENT DOCUMENTS

CN 100445569 C * 12/2008
CN 103292385 A * 9/2013
(Continued)

OTHER PUBLICATIONS

International Search Report and Written Opinion for International Application No. PCT/KR2022/019685; International Filing Date Dec. 6, 2022; Date of Mailing Mar. 14, 2023, 10 Pages.

*Primary Examiner* — Courtney D Heinle
*Assistant Examiner* — Art Golik
(74) *Attorney, Agent, or Firm* — CANTOR COLBURN LLP

(57) ABSTRACT

A blowing device according to an embodiment may include a base portion, an air inflow portion, a blowing body connected to be in fluid communication with an upper end of the base portion, a blowing portion configured to move the air introduced from the air inflow portion to the blowing body, a first driving motor configured to apply a driving force to the blowing portion, a separation wall dividing the inside of the blowing body into a first inner region and a second inner region, a first discharge portion configured to discharge air accommodated in the first inner region to the outside, a second discharge portion configured to discharge air accommodated in the second inner region to the outside, and a flow rate distribution portion configured to distribute the air moved from the blowing portion to the first inner region and the second inner region.

18 Claims, 12 Drawing Sheets

(51) Int. Cl.

| | |
|---|---|
| *F04D 25/10* | (2006.01) |
| *F04D 27/00* | (2006.01) |
| *F04D 27/02* | (2006.01) |
| *F04D 29/46* | (2006.01) |
| *F04D 29/56* | (2006.01) |
| *F24F 8/167* | (2021.01) |

(52) U.S. Cl.
CPC ..... *F04D 27/002* (2013.01); *F04D 27/0246* (2013.01); *F04D 29/462* (2013.01); *F04D 29/464* (2013.01); *F04D 29/563* (2013.01); *F04D 29/70* (2013.01); *F24F 8/167* (2021.01)

(58) Field of Classification Search
CPC .... F04D 27/0246; F04D 25/10; F04D 29/541; F04D 29/70; F24F 8/167
See application file for complete search history.

(56) References Cited

U.S. PATENT DOCUMENTS

| | | | | |
|---|---|---|---|---|
| 2021/0107337 | A1* | 4/2021 | Othmer | B60H 1/00564 |
| 2022/0228759 | A1* | 7/2022 | Varma | F04F 5/16 |
| 2023/0383758 | A1 | 11/2023 | Horton et al. | |
| 2023/0392611 | A1 | 12/2023 | Peet et al. | |

FOREIGN PATENT DOCUMENTS

| | | | | | |
|---|---|---|---|---|---|
| CN | 203835761 | U | * | 9/2014 | |
| CN | 103292385 | B | | 7/2015 | |
| CN | 104863871 | A | | 8/2015 | |
| CN | 107781143 | A | | 3/2018 | |
| CN | 109281850 | A | * | 1/2019 | F04D 25/08 |
| CN | 107636317 | B | * | 10/2019 | F04D 29/66 |
| CN | 111075741 | A | | 4/2020 | |
| JP | 2009030953 | A | * | 2/2009 | |
| JP | 5828134 | B2 | | 12/2015 | |
| JP | 6046365 | B2 | | 12/2016 | |
| JP | 2017067064 | A | | 4/2017 | |
| JP | 2021036632 | A | | 3/2021 | |
| KR | 101370271 | B1 | | 3/2014 | |
| KR | 20210080545 | A | | 6/2021 | |
| KR | 20210080546 | A | | 6/2021 | |
| WO | WO-2011046289 | A2 | * | 4/2011 | F24F 1/06 |
| WO | WO-2016027309 | A1 | * | 2/2016 | F04D 17/04 |

* cited by examiner

BLOWING DEVICE AND BLOWING DEVICE OPERATING METHOD

CROSS-REFERENCE TO RELATED APPLICATIONS

This application is a continuation application, claiming priority under § 365 (c), of International Application No. PCT/KR2022/019685, filed on Dec. 6, 2022, which is based on and claims the benefit of Korean patent application number 10-2022-0012581 filed on Jan. 27, 2022, in the Korean Intellectual Property Office, the disclosures of which are incorporated by reference herein in their entireties.

TECHNICAL FIELD

The disclosure relates to a blowing device capable of adjusting a wind direction of air discharged through a discharge portion and an operating method of the blowing device.

BACKGROUND ART

Blowing devices may be used as means to forcibly form a flow of air for circulation in an indoor space or to transmit coolness to users by forming a strong airflow around users. Blowing devices have been improved to send air a long distance by forming a strong airflow, or to provide coolness by transmitting the strong airflow to users, or have been improved to provide comfort to users by providing natural airflow, such as natural wind, around users.

Blowing devices of the related art suggest a structure in which air made to flow by a fan may be directly transmitted to users. In the case of such a structure, there is a characteristic that the discharged air may be transmitted a long distance, but there is a problem that an overly strong airflow may be transmitted to users, which may cause the users to experience some discomfort.

In addition, in blowing devices of the related art, the entire structure including a discharge portion moves and controls a wind direction, which causes problems in that vibration of the structure with the discharge portion and excessive power consumption to rotate the structure with the discharge portion may occur.

DISCLOSURE

Technical Problem

An aspect of the disclosure provides a blowing device that allows users to feel comfortable by indirectly discharging flowing air through a blowing fan and an operating method of the blowing device.

Another aspect of the disclosure provides a blowing device capable of adjusting a direction of air discharged from a discharge portion by adjusting a flow rate distribution portion and an operating method of the blowing device.

Another aspect of the disclosure provides a blowing device discharging purified air from a discharge portion and an operating method of the blowing device.

Technical Solution

A blowing device according to an example includes a base portion having an accommodation space therein, an air inflow portion disposed on one side of the base portion and through which air is introduced from outside, a blowing body extending in a first direction, provided in a shape of a conduit with a blocked upper end, and connected to be in fluid communication with an upper end of the base portion, a blowing portion disposed on the base portion and configured to move the air introduced from the air inflow portion to the blowing body, a first driving motor configured to apply driving force to the blowing portion, a separation wall disposed inside the blowing body and extending in the first direction to divide the inside of the blowing body into a first inner region and a second inner region, a first discharge portion disposed on a side portion of the blowing body and configured to discharge air accommodated in the first inner region to the outside, a second discharge portion disposed on the side portion of the blowing body and configured to discharge air accommodated in the second inner region to the outside, and a flow rate distribution portion disposed between the blowing portion and the separation wall and configured to distribute the air moved from the blowing portion to the first inner region and the second inner region.

The flow rate distribution portion may include a flat plate member extending along a plane, and be disposed at a lower end of the separation wall to be rotatable around a central axis.

The blowing device may further include a second driving motor configured to apply power so that the flow rate distribution portion is rotatable around the central axis, and a controller configured to control the second driving motor.

The flow rate distribution portion may rotate by 60 degrees or less clockwise and by 60 degrees or less counterclockwise around the central axis.

The flow rate distribution portion may be provided in a semicircular shape.

A side portion of the blowing body may be provided in a cylindrical shape extending in the first direction.

A first discharge portion may include a 1-1 outer wall portion and a 1-2 outer wall portion spaced apart from each other in a thickness direction of a side portion of the blowing body, and a first release portion disposed between the 1-1 outer wall portion and the 1-2 outer wall portion.

One end of the 1-1 outer wall portion may have a tapered shape whose width narrows toward the first release portion, and the 1-2 outer wall portion may be provided in a curved shape.

The second release portion may include a 2-1 outer wall portion and a 2-2 outer wall portion spaced apart from each other in a thickness direction of a side portion of the blowing body, and a second release portion disposed between the 2-1 outer wall portion and the 2-2 outer wall portion.

One end of the 2-1 outer wall portion may have a tapered shape whose width narrows toward the second release portion, and the 2-2 outer wall portion may be provided in a curved shape.

The first discharge portion and the second discharge portion may be disposed to be symmetrical to each other with respect to the separation wall.

The first discharge portion may be disposed at 90 degrees or more and below 180 degrees counterclockwise along an outer circumferential surface of a side portion of the blowing body from one side of the separation wall, and may be disposed at 90 degrees or more and less than 180 degrees clockwise along the outer circumferential surface of the side portion of the blowing body from the one side of the separation wall.

The blowing portion may include a first blowing fan and a second blowing fan disposed on upper and lower portions in the first direction, and a first fan housing and a second fan housing disposed to surround the first blowing fan and the second blowing fan, the second fan housing may include a suction hole through which the air introduced from the air inflow portion is introduced in the first direction, and the first fan housing may include a discharge hole through which the air introduced from the suction hole is discharged in the first direction.

The blowing device may further include a dust collection portion disposed between the air inflow portion and the blowing portion, and a photocatalyst portion disposed between the air inflow portion and the blowing portion.

An operating method of a blowing device according to an example includes operating the first drive motor, transmitting the air introduced into the air inflow portion to the blowing body, distributing a flow rate of the air transmitted to each of the first inner region and the second inner region using the flow rate distribution portion, discharging air of a first flow path using the first discharge portion and discharging air of a second flow path using the second discharge portion, moving the air of the first flow path and the air of the second flow path along the outer circumferential surface of the blowing body, and forming an airflow of mixed air moving in a certain direction by mixing the air of the first flow path and the air of the second flow path.

The flow rate distribution portion may include a flat plate member extending along a plane, and be disposed at a lower end of the separation wall to be rotatable around a central axis.

The operating method may further include adjusting an angle at which the flow rate distribution portion rotates around the central axis, a flow rate of air transmitted to each of the first inner region and the second inner region may change according to the angle at which the flow rate distribution portion rotates around the central axis, and a direction of the airflow of the mixed air may change.

The operating method may further include a second driving motor configured to apply power so that the flow rate distribution portion is rotatable around the central axis, and a controller configured to control the second driving motor.

The flow rate distribution portion may rotate by 60 degrees or less clockwise and by 60 degrees or less counterclockwise around the central axis.

The operating method may further include collecting fine dust from the air introduced into the air inflow portion, and removing contaminants from the air introduced into the air inflow portion using a photocatalyst.

Advantageous Effects

According to an embodiment of the disclosure, a blowing device that allows users to feel comfortable by indirectly discharging flowing air through a blowing fan and an operating method of the blowing device may be provided.

Also, according to an embodiment of the disclosure, a direction of air discharged from a discharge portion may be adjusted by adjusting a flow rate distribution portion, and thus, convenience of use and design convenience of manufacturers may be improved.

Also, according to an embodiment of the disclosure, a blowing device discharging purified air from a discharge portion and an operating method of the blowing device may be provided.

BEST MODE

Mode for Invention

Figure 1:
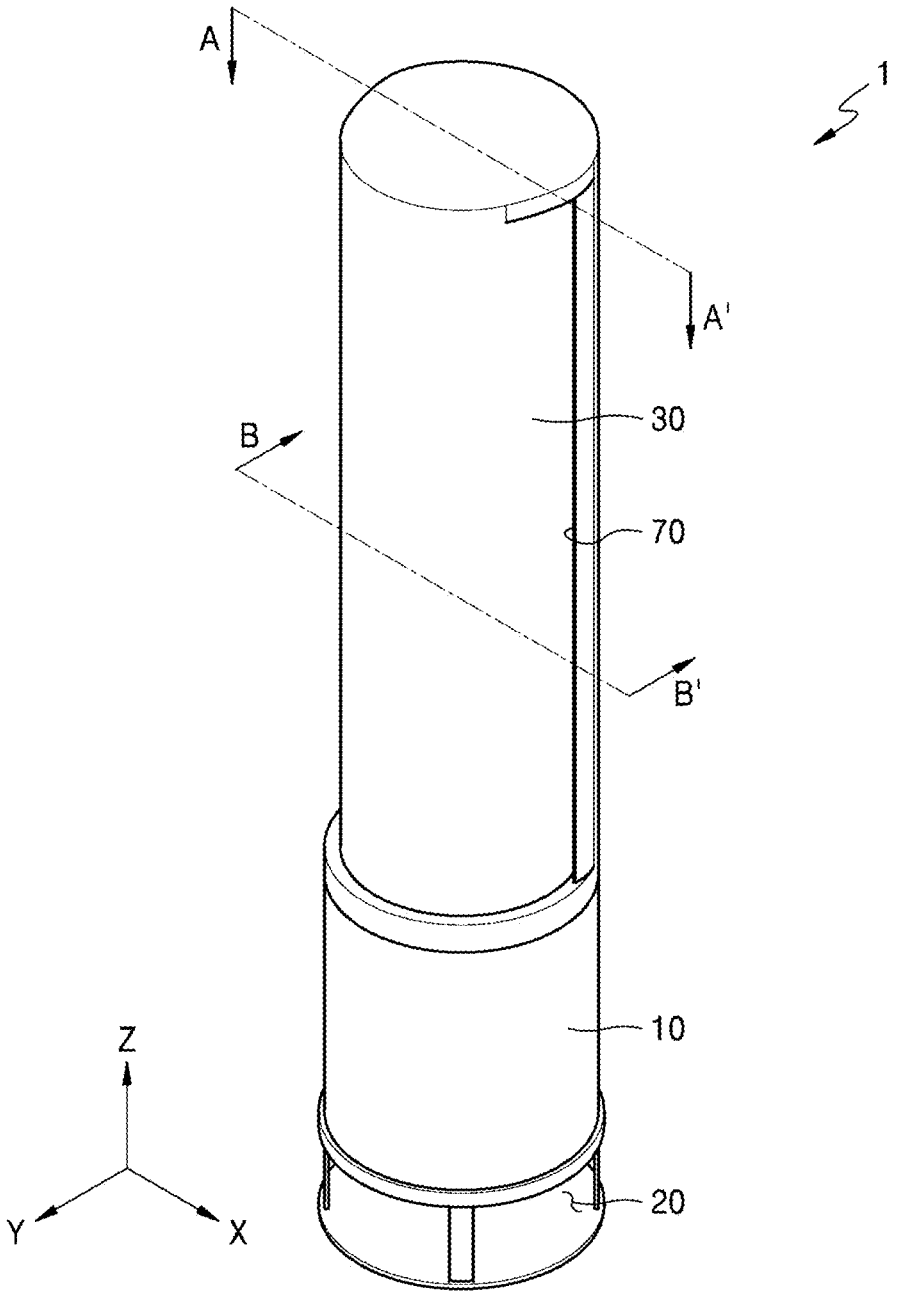
FIG. 1 is a perspective view of a blowing device according to an example.

Hereinafter, a configuration and operations of the disclosure will be described in detail through embodiments of the accompanying drawings.

Terms used in this specification will be briefly described, and the disclosure will be described in detail.

Although general terms that are currently widely used were selected as terminology used in the disclosure while considering the functions of the disclosure, they may vary according to intentions of one of ordinary skill in the art, judicial precedents, the advent of new technologies, etc. Terms arbitrarily selected by the applicant of the disclosure may also be used in a specific case. In this case, their meanings will be described in detail in the detailed description of the disclosure. Hence, the terms must be defined based on the meanings of the terms and the contents of the entire specification, not by simply stating the terms themselves.

It will be understood that when a certain part "comprises" or "includes" a certain component, the part does not exclude another component but may further include another component, unless the context clearly dictates otherwise.

Also, the terms "first", "second", etc. do not have limited meanings, and only used to distinguish one component from another.

Hereinafter, embodiments of the disclosure will be described in detail with reference to the accompanying drawings such that one of ordinary skill in the art to which the disclosure belongs may easily embody the embodiments. The disclosure may, however, be embodied in many different forms and should not be construed as being limited to the embodiments set forth herein. In the drawings, portions that are irrelevant to the descriptions may be not shown in order to clarify the disclosure, and throughout the specification, similar portions are assigned similar reference numerals.

Meanwhile, in the following description, the terms "upper", "lower", "front-rear direction", etc. are defined based on the drawings, and the shapes and positions of the components are not limited by the terms.

Hereinafter, the embodiments of the disclosure will be described in detail with reference to the accompanying drawings.

Figure 2A:
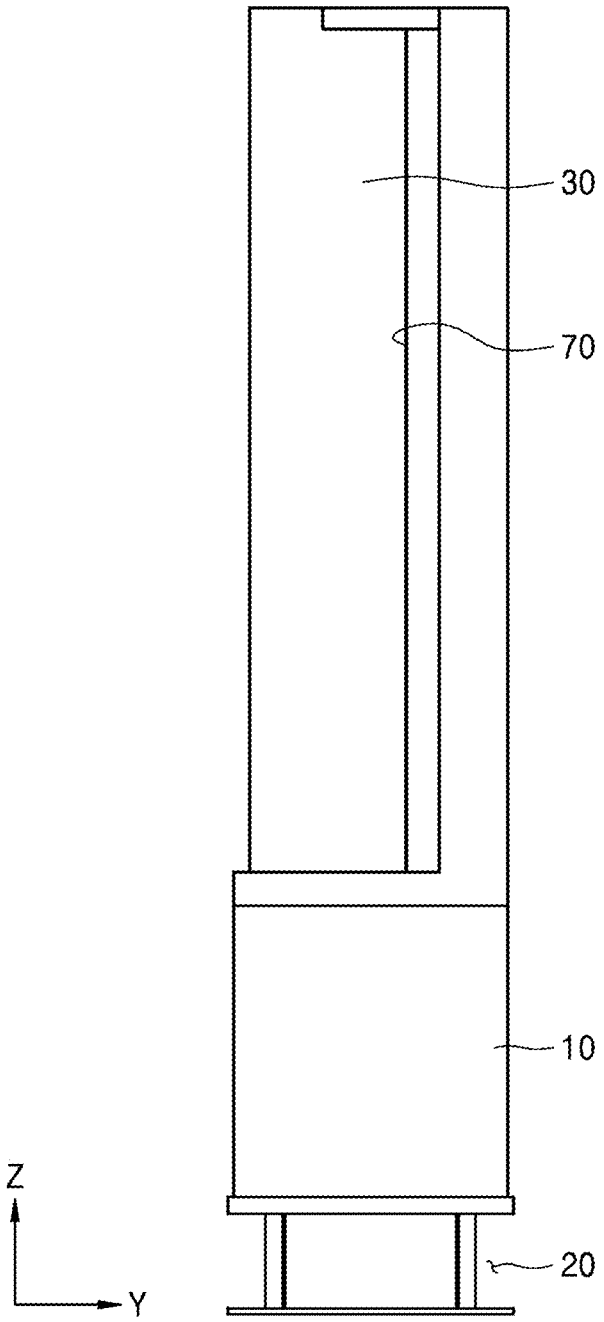
FIG. 2A is a side view of the blowing device shown in FIG. 1.
Figure 2B:
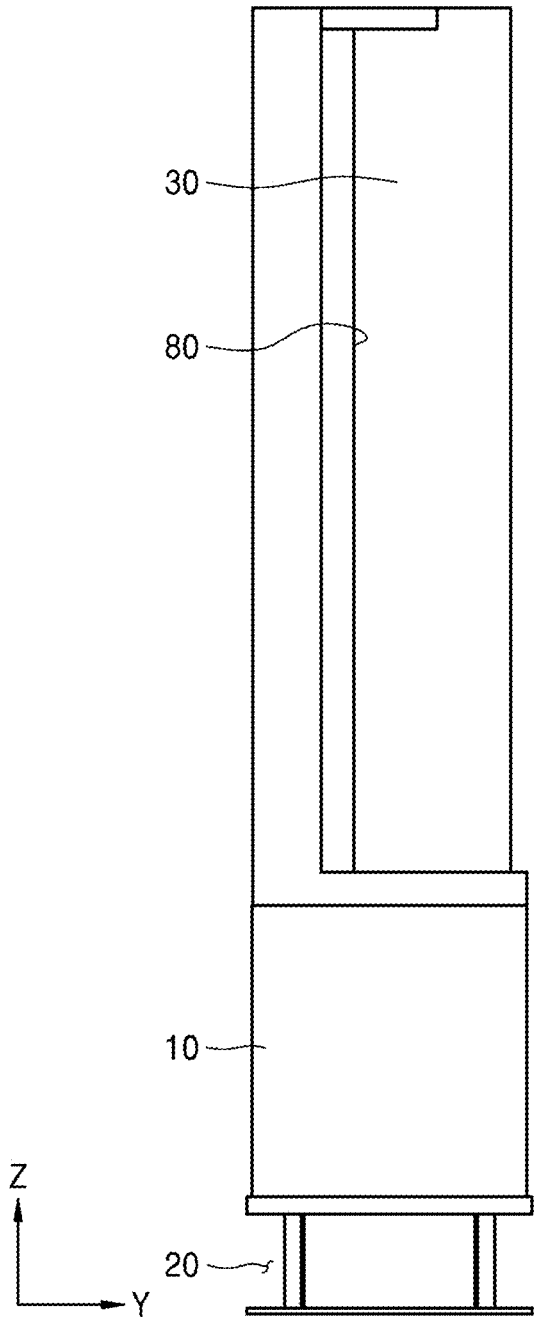
FIG. 2B is a multiportion side view of the blowing device shown in FIG. 1.
Figure 3:
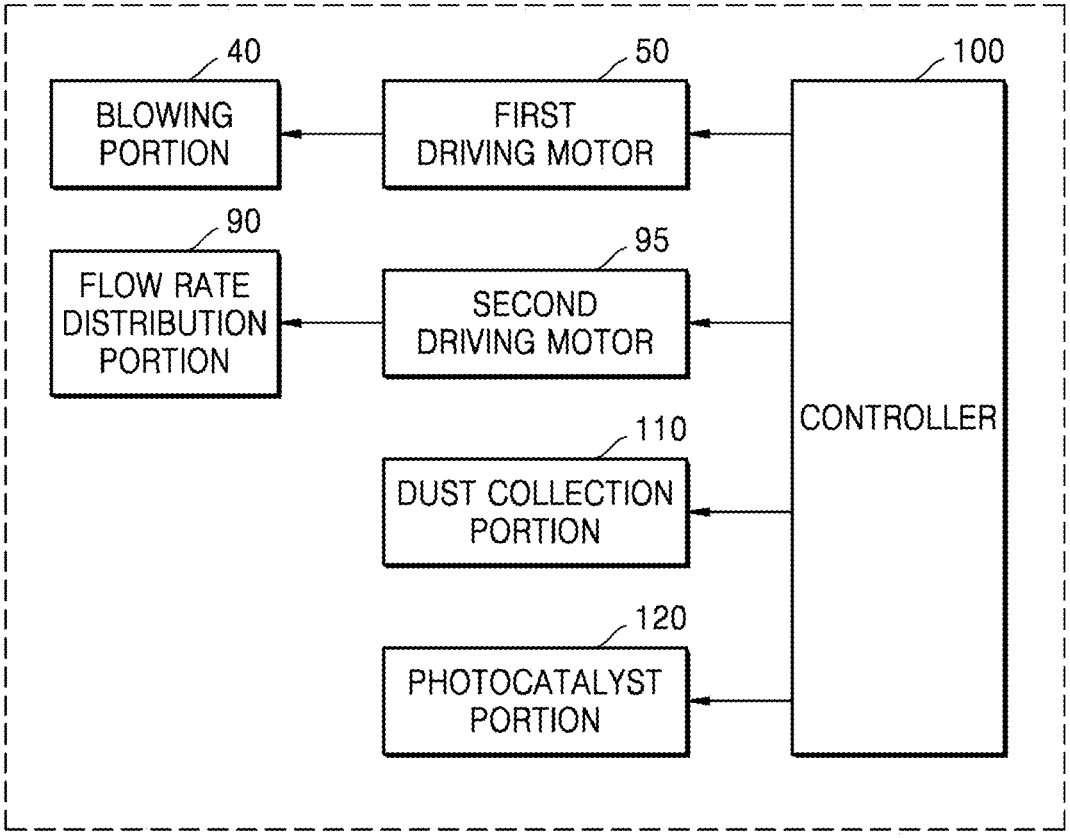
FIG. 3 is a block diagram of the blowing device according to an example.
Figure 4:
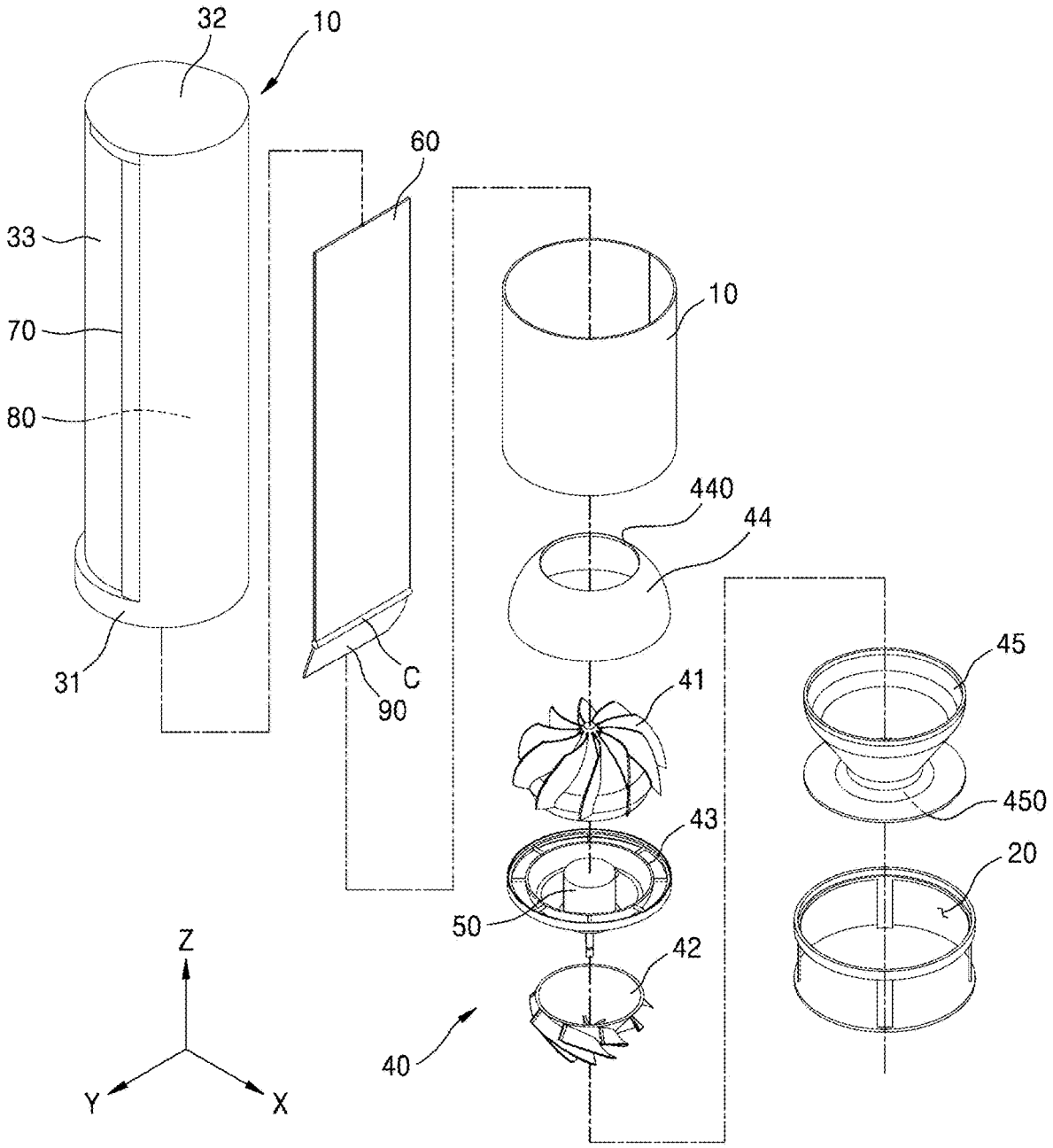
FIG. 4 is an exploded perspective view of the blowing device shown in FIG. 1.
Figure 5:
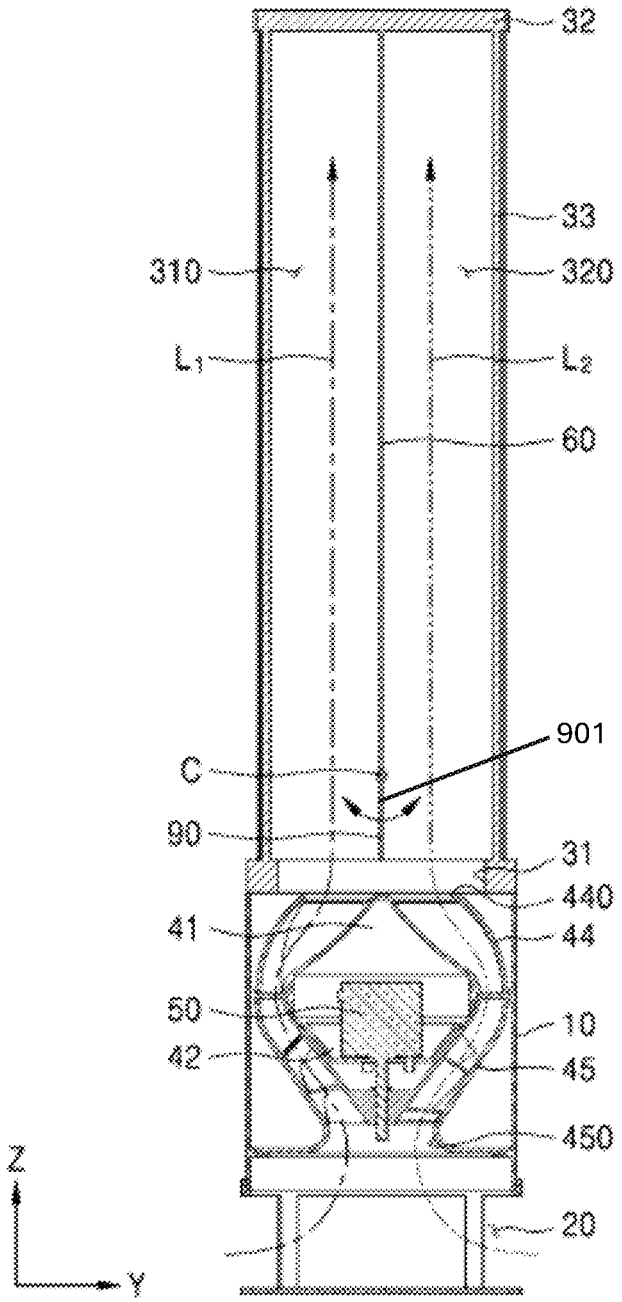
FIG. 5 is a cross-sectional view of the blowing device shown in FIG. 1, taken along a line A-A' of FIG. 1.
Figure 6:
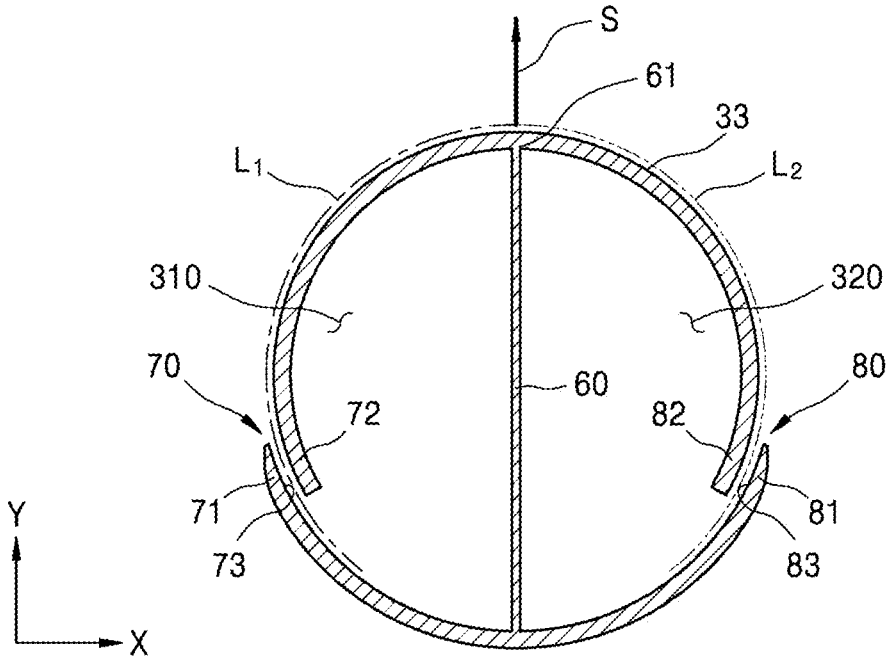
FIG. 6 is a cross-sectional view of the blowing device shown in FIG. 1, taken along a line B-B' of FIG. 1.

FIG. 1 is a perspective view of a blowing device according to an example. FIG. 2A is a side view of the blowing device shown in FIG. 1. FIG. 2B is a multiportion side view of the blowing device shown in FIG. 1. FIG. 3 is a block diagram of the blowing device according to an example. FIG. 4 is an exploded perspective view of the blowing device shown in FIG. 1. FIG. 5 is a cross-sectional view of the blowing device shown in FIG. 1, taken along a line A-A'. FIG. 6 is a cross-sectional view of the blowing device shown in FIG. 1, taken along a line B-B'.

Referring to FIGS. 1 to 6, a blowing device 1 according to an example may include a base portion 10, an air inflow portion 20 through which outside air is introduced, a blowing body 30 disposed on an upper portion of the base portion 10, a blowing portion 40 moving air introduced from the air inflow portion 20 to the blowing body 30, a first driving motor 50 applying a driving force to the blowing portion 40, a separation wall 60, a first discharge portion 70, a second discharge portion 80, a flow rate distributor (hereinafter referred to as a "flow rate distribution portion") 90, and a controller 100.

The base portion 10 is a housing member having an accommodation space therein. As an example, the base portion 10 may have a cylindrical shape extending in a first direction (Z direction), and may include an opening at an upper end thereof.

The air inflow portion 20 is an air inflow passage through which air is introduced from the outside, such as an exterior of the blowing device 1. According to an example, the air inflow portion 20 fluidly communicates with an inside and with an outside of the base portion 10. As an example, one or more air inflow portions 20 may be disposed on one side of the base portion 10. For example, when the base portion 10 has a cylindrical shape, the air inflow portion 20 may be disposed on an outer circumference of the cylindrical shape.

For example, when a plurality of air inflow portions 20 are provided, the plurality of air inflow portions 20 may be sequentially disposed along the outer circumference of the cylindrical shape. For example, the plurality of air inflow portions 20 may be evenly disposed in a circumferential direction along an outer circumferential surface of the base portion 10 such that air may be sucked in from any direction with respect to the base portion 10. As shown in FIG. 2A, the plurality of air inflow portions 20 are disposed to be spaced apart from each other in the circumferential direction of the base portion 10 and may extend in an elongate manner in an up and down or vertical direction. However, the disclosure is not limited thereto, and the air inflow portion 20 may be provided in any shape capable of communicating inside and outside of the base portion 10 and may be disposed at any position.

The blowing body 30 may be connected to an upper end of the base portion 10 in fluid communication to form a flow path. As an example, the blowing body 30 may extend in the first direction (Z direction) and may be provided in the shape of a conduit with a blocked upper end. For example, the blowing body 30 may be formed in a cylindrical shape extending in the first direction (Z direction).

According to an example, when the blowing body 30 is provided in the cylindrical shape extending in the first direction (Z direction), a lower end 31 of the blowing body 30 may be provided in the shape of an opening. Accordingly, the blowing body 30 may form the flow path through fluid communication with the base portion 10 which will be described below. An upper end 32 of the blowing body 30 may be implemented as a blocking wall extending along one plane to block the flow path formed from the lower end 31. A side portion 33 of the blowing body 30 may be provided in the shape of a conduit extending in the first direction (Z direction). In this case, the side portion 33 of the blowing body 30 may be formed in a cylindrical shape. For example, as shown in FIG. 6, a cross-sectional shape of the side portion 33 of the blowing body 30 cut along one plane (XY plane) perpendicular to the first direction (Z direction) may be provided in a circular shape. However, the disclosure is not limited, and the side portion 33 of the blowing body 30 may be provided in any curved shape in which air discharged from the first discharge portion 70 and the second discharge portion 80 may move along the outer circumferential surface of the blowing body 30 by the Coanda effect. For example, the side portion 33 of the blowing body 30 may be provided in an any curved shape having a curved cross-sectional shape cut along the plane (XY plane) perpendicular to the first direction (Z direction).

According to an example, the blowing body 30 may be disposed on an upper side of the base portion 10. As described above, the lower end 31 of the blowing body 30 may be provided in the shape of the opening, and the lower end 31 of the blowing body 30 may be disposed to be in fluid communication with the upper end of the base portion 10. Accordingly, the blowing body 30 may be disposed on an upper portion of the blowing portion 40 accommodated in the base portion 10. As the blowing body 30 is disposed on the upper portion of the blowing portion 40, the flow path may be formed inside the blowing body 30 in which air transferred from the blowing portion 40 passes through the lower end 31 of the blowing body 30 and moves in the first direction (Z direction).

The blowing portion 40 may move the air introduced from the air inflow portion 20 to the blowing body 30. According to an example, the blowing portion 40 may be disposed to be accommodated in the base portion 10. The blowing portion 40 may be disposed on an upper portion of the air inflow portion 20 in the first direction (Z direction). Accordingly, a flow path of air leading to the air inflow portion 20, the blowing portion 40, and the blowing body 30 may be formed.

As an example, one or more of a dust collection portion 110 or a photocatalyst portion 120 may be disposed between the air inflow portion 20 and the blowing portion 40. For example, the dust collection portion 110 can be a purification device capable of removing contaminants by adsorbing contaminants included in outside air to the dust collection portion 110. As an example, the dust collection portion 110 may adsorb contaminants using a dust collection filter. However, the disclosure is not limited thereto, and other types of dust collection portions removing contaminants may be used. The photocatalyst portion 120 may include a photocatalyst filter including titanium oxide, silver, etc. The photocatalyst filter may be used to produce a sterilization effect on outside air. However, the disclosure is not limited thereto, and other types of photocatalyst portions removing contaminants may be used. The dust collection portion 110 and the photocatalyst portion 120 are described as examples in the above-described embodiment, but any purification device capable of purifying outside air may be disposed between the air inflow portion 20 and the blowing portion 40.

According to an example, when one or more of the dust collection portion 110 or the photocatalyst portion 120 is disposed between the air inflow portion 20 and the blowing portion 40, purified air from which contaminants have been removed from the outside air may pass through the blowing portion 40 and be supplied to the blowing body 30.

The blowing portion 40 according to an example may include a first blowing fan 41, a second blowing fan 42, a blowing fan support portion 43, a first fan housing 44, and a second fan housing 45. As an example, the first blowing fan 41 and the second blowing fan 42 may be disposed in the up and down direction in the first direction (Z direction), and the blowing fan support portion 43 may be disposed between the first blowing fan 41 and the second blowing fan 42. The first driving motor 50 applying a driving force to the blowing portion 40 may be seated in the center of the blowing fan support portion 43. The first fan housing 44 and the second fan housing 45 may be disposed to surround the first blowing fan 41 and the second blowing fan 42.

The first blowing fan 41 and the second blowing fan 42 may each include a plurality of blades rotatable around a central axis extending in the first direction (Z direction). The central axes of the first blowing fan 41 and the second blowing fan 42 may be coupled to a rotation shaft of the first driving motor 50 supported by the blowing fan support portion 43 and receive rotational force.

The first fan housing 44 may include a circular discharge hole 440 provided in a hemispherical shape and disposed thereon. The second fan housing 45 may include a circular suction hole 450 provided in a hemispherical shape to be coupled to the first fan housing 44 and disposed therebelow. The first fan housing 44 and the second fan housing 45 may be coupled to each other to form a housing space in which the first blowing fan 41 and the second blowing fan 42 are accommodated. The air passing through the air inflow portion 20 may flow into the suction hole 450 in the first direction (Z direction), be transferred through the second blowing fan 42 and the first blowing fan 41, and then be discharged to an upper portion, for example, the blowing body 30, in the first direction (Z direction) through the discharge hole 440.

As shown in FIG. 5, the separation wall 60 may be disposed inside the blowing body 30 to divide the inside of the blowing body 30 into a first inner region 310 and a second inner region 320. As an example, the separation wall 60 may be provided in the shape of a flat plate extending along one plane (XZ plane or YZ plane) parallel to the first direction (Z direction). For example, the separation wall 60 may be disposed to extend from the upper end 32 to the lower end 31 of the blowing body 30. Accordingly, the inside of the blowing body 30 may be divided into the first inner region 310 and the second inner region 320 with respect to the separation wall 60. As an example, the first inner region 310 and the second inner region 320 may be symmetrical to each other with respect to the separation wall 60. However, the disclosure is not limited thereto, and for example, the first inner region 310 and the second inner region 320 may be disposed to be asymmetrical to each other with respect to the separation wall 60.

In an exemplary case in which the first inner region 310 and the second inner region 320 are asymmetrical, the separation wall 60 can be disposed at an offset position relative to a central axis of the flowing body 30. In these or other cases, one of the first inner region 310 and the second inner region 320 will have a larger volume than the other.

As an example, as the separation wall 60 is disposed inside the blowing body 30, air introduced into the blowing body 30 through the blowing portion 40 may be distributed with respect to the separation wall 60. For example, the flow path of air flowing into the blowing body 30 through the blowing portion 40 may be divided into a first flow path $L_1$ flowing into the first inner region 310 and a second flow path $L_2$ flowing into the second inner region 320.

According to an example, when the first inner region 310 and the second inner region 320 are symmetrically disposed by the separation wall 60, a flow rate of the first flow path $L_1$ flowing into the first inner region 310 may be substantially the same as a flow rate of the second flow path $L_2$ flowing into the second inner region 320. On the other hand, when the first inner region 310 and the second inner region 320 are asymmetrically disposed by the separation wall 60, the flow rate of the first flow path $L_1$ flowing into the first inner region 310 may be different from the flow rate of the second flow path $L_2$ flowing into the second inner region 320.

The first discharge portion 70 is a discharge portion disposed in the blowing body 30 to discharge air accommodated in the first inner region 310 of the blowing body 30 to the outside. As an example, the first discharge portion 70 may be disposed on a side portion 33 of the blowing body 30. For example, the first discharge portion 70 may be provided in the shape of a slit extending in the first direction (Z direction). Accordingly, air along the first flow path $L_1$ in the first inner region 310 may be discharged to the outside through the first discharge portion 70.

Referring to FIGS. 2A and 6, the first discharge portion 70 according to an example may include a first, first (hereinafter referred to as a "1-1") outer wall portion 71 and a first, second (hereinafter referred to as a "1-2") outer wall portion 72 spaced apart from each other in a thickness direction of the side portion 33 of the blowing body 30, and a first release portion 73 formed in a space between the 1-1 outer wall portion 71 and the 1-2 outer wall portion 72. According to an example, the 1-1 outer wall portion 71 may be formed to extend along an outer circumferential surface of the side portion 33 of the blowing body 30. One end of the 1-1 outer wall portion 71 may have a tapered shape whose width narrows toward the first release portion 73. According to an example, the 1-2 outer wall portion 72 may be formed to extend along the outer circumferential surface of the side portion 33 of the blowing body 30. The 1-2 outer wall portion 72 may be provided in a curved shape. The 1-1 outer wall portion 71 and the 1-2 outer wall portion 72 may be disposed to overlap along the outer circumferential surface of the side portion 33 of the blowing body 30. As an example, the first release part 73 may be formed in a region where the 1-1 outer wall portion 71 and the 1-2 outer wall portion 72 overlap. For example, the first release portion 73 may be formed in a region spaced in the thickness direction of the side portion 33 of the blowing body 30, in the region where the 1-1 outer wall portion 71 and the 1-2 outer wall portion 72 overlap. As an example, when the blowing body 30 has a circular cross-section, the first release portion 73 may be formed in a diameter direction of the circular cross-section of the blowing body 30.

Referring to FIGS. 2B and 6, the second discharge portion 80 is a discharge portion disposed in the blowing body 30 to discharge air accommodated in the second inner region 320 of the blowing body 30 to the outside. As an example, the second discharge portion 80 may be disposed on the side portion 33 of the blowing body 30. For example, the second discharge portion 80 may be provided in the shape of a slit extending in the first direction (Z direction). Accordingly, air along the second flow path $L_2$ in the second inner region 320 may be discharged to the outside through the second discharge portion 80.

The second discharge portion 80 according to an example may include a second, first (hereinafter referred to as a "2-1") outer wall portion 81 and a second, second (hereinafter referred to as a "2-2") outer wall portion 82 spaced apart from each other in the thickness direction of the side portion 33 of the blowing body 30, and a second release portion 83 formed in space between the 2-1 outer wall portion 81 and the 2-2 outer wall portion 82. According to an example, the 2-1 outer wall 81 may be formed to extend along the outer circumferential surface of the side portion 33 of the blowing body 30. One end of the 2-1 outer wall portion 81 may have a tapered shape whose width narrows toward the second release portion 83. According to an example, the 2-2 outer wall portion 82 may be formed to extend along the outer circumferential surface of the side portion 33 of the blowing body 30. The 2-2 outer wall portion 82 may be provided in a curved shape. The 2-1 outer wall portion 81 and the 2-2 outer wall portion 82 may be disposed to overlap along the outer circumferential surface of the side portion 33 of the blowing body 30. As an example, the second release portion 83 may be formed in a region where the 2-1 outer wall portion 81 and the 2-2 outer wall portion 82 overlap. For example, the second release portion 83 may be formed in a region spaced in the thickness direction of the side portion 33 of the blowing body 30, in the region where the 2-1 outer wall portion 81 and the 2-2 outer wall portion 82 overlap. As an example, when the blowing body 30 has a circular cross-section, the second release portion 83 may be formed in the diameter direction of the circular cross-section of the blowing body 30.

As described above, air along the first flow path $L_1$ in the first inner region 310 may be discharged to the outside through the first discharge portion 70, and air along the second flow path $L_2$ in the second inner region 320 may be discharged to the outside through the second discharge portion 80. Accordingly, the first discharge portion 70 may be disposed in the first inner region 310 of the blowing body 30, and the second discharge portion 80 may be disposed in the second inner region 320 of the blowing body 30.

According to an example, when the first inner region 310 and the second inner region 320 are disposed to be symmetrical to each other with respect to the separation wall 60, the first discharge portion 70 and the second discharge portion 80 may also be disposed to be symmetrical to each other with respect to the separation wall 60. As an example, the first discharge portion 70 may be disposed at 90 degrees or more and less than 180 degrees counterclockwise along the outer circumferential surface of the side portion 33 of the blowing body from one side 61 of the separation wall 60 (i.e., between 90 and 180 degrees). The second discharge portion 80 may be disposed at 90 degrees or more and less than 180 degrees clockwise along the outer circumferential surface of the side portion 33 of the blowing body from one side 61 of the separation wall 60 (i.e., between 90 and 180 degree). However, the disclosure is not limited thereto, and the first discharge portion 70 and the second discharge portion 80 may be disposed at any positions where the air along the first flow path $L_1$ and the air along the second flow path $L_2$ respectively accommodated in the first inner region 310 and the second inner region 320 may be discharged to the outside.

In an exemplary case in which the first inner region 310 and the second inner region 320 are asymmetrical and one of the first inner region 310 and the second inner region 320 will have a larger volume than the other, the first discharge portion 70 and the second discharge portion 80 may be disposed at positions that correspond to the differences in volume of the first inner region 310 and the second inner region 320.

According to an example, the air along the first flow path $L_1$ discharged through the first release portion 73 may move along the 1-2 outer wall portion 72. As an example, because the 1-2 outer wall portion 72 may have the curved shape, the air along the first flow path $L_1$ discharged through the first release portion 73 by the Coanda effect may move along the outer circumferential surface of the side portion 33 of the blowing body. For example, the air along the first flow path $L_1$ discharged through the first release portion 73 may rotate clockwise along the outer circumferential surface of the side portion 33 of the blowing body.

In addition, the air along the second flow path $L_2$ discharged through the second release portion 83 may move along the 2-2 outer wall portion 82. As an example, because the 2-2 outer wall portion 82 may have the curved shape, the air along the second flow path $L_2$ discharged through the second release portion 83 by the Coanda effect may move along the outer circumferential surface of the side portion 33 of the blowing body. For example, the air along the second flow path $L_2$ discharged through the second release portion 83 may rotate counterclockwise along the outer circumferential surface of the side portion 33 of the blowing body.

When the air along the first flow path $L_1$ rotates clockwise along the outer circumferential surface of the side portion 33 of the blowing body and the air along the second flow path $L_2$ rotates counterclockwise along the outer circumferential surface of the side portion 33 of the blowing body, the air along the first flow path $L_1$ and the air along the second flow path $L_2$ may be mixed at a certain position on the side portion 33 of the blowing body to form an airflow S of the mixed air. As an example, the airflow S of the mixed air may be formed in a straight line in the thickness direction of the side portion 33 of the blowing body, for example, when the side portion 33 of the blowing body has a circular cross-section, in the diameter direction of the circular cross-section.

According to an example, the airflow S of the mixed air may be formed by a combination of the air along the first flow path $L_1$ and the air along the second flow path $L_2$. Accordingly, a direction of the airflow S of the mixed air may be determined by the balance of forces of the air along the first flow path $L_1$ and the air along the second flow path $L_2$. For example, when the forces of the air along the first flow path $L_1$ and the air along the second flow path $L_2$ are the same, as shown in FIG. 6, the direction of the airflow S of the mixed air may be formed in a second direction (Y direction). Because the direction of the airflow S of the mixed air may be determined by the balance of the air along the first flow path $L_1$ and the air along the second flow path $L_2$, when the flow rate of the air along the first flow path $L_1$ and the flow rate of the air along the second flow path $L_2$ is adjusted, the direction of the airflow S of the mixed air may also be adjusted.

However, as described above, the separation wall 60 may be disposed to be fixed inside the blowing body 30. Therefore, when the separation wall 60 is disposed to be fixed inside the blowing body 30, the first inner region 310 and the second inner region 320 are also separated to be fixed. Accordingly, the flow rate of air introduced into the blowing body 30 through the blowing portion 40 may be separated at a predefined ratio according to the position of the separation wall 60. That is, the flow rate of the first flow path $L_1$ and the flow rate of the second flow path $L_2$ may be fixed. According to an example of the disclosure, in order to adjust the flow rate of the first flow path $L_1$ and the flow rate of the second flow path $L_2$, the flow rate distribution portion 90 may be disposed.

In accordance with additional embodiments, the separation wall 60 may not be fixed and may be provided to be adjustable. In the or other cases, the blowing body 30 may be provided with an electro-mechanical arrangement that is configured to move the separation wall 60 in one or more directions (i.e., horizontally) to adjust the relative volumes of the first inner region 310 and the second inner region 320. The controller 100 can be configured to control a displacement of the separation wall 60.

The flow rate distribution portion 90 may distribute air moving from the blowing portion 40 to the first inner region 310 and the second inner region 320. The flow rate distribution portion 90 according to an example may be disposed between the blowing portion 40 and the separation wall 60 to distribute the air moving from the blowing portion 40 to the first inner region 310 and the second inner region 320.

The flow rate distribution portion 90 according to an example may include a flat plate member extending along a plane. As used herein, the flat plate member can include or be provided as a flow rate distributor 901. For example, the flow rate distribution portion 90 may be provided in a semicircular plate shape extending along one plane. As an example, the flow rate distribution portion 90 may be disposed at a lower end of the separation wall 60 to be rotatable around a central axis C. For example, the flow rate distribution portion 90 may rotate by 60 degrees or less clockwise and by 60 degrees or less counterclockwise around the central axis C. However, the disclosure is not limited thereto, and a rotation angle of the flow rate distribution portion 90 may be determined differently according to a flow rate distribution ratio of the air along the first flow path L1 and the air along the second flow path L2.

As the flow rate distribution portion 90 rotates around the central axis C, the air moving from the blowing portion 40 may be guided to the first inner region 310 and the second inner region 320. The flow rate of the first flow path $L_1$ moving to the first inner region 310 and the flow rate of the second flow path $L_2$ moving to the second inner region 320 may be adjusted according to the rotation angle of the flow rate distribution portion 90. According to an example, the central axis C of the flow rate distribution portion 90 may be coupled to a rotation shaft of the second driving motor 95 that applies power to the central axis C and receive rotational force. The controller 100 may control the second driving motor 95 to adjust the rotation angle of the flow rate distribution portion 90. Hereinafter, a method of adjusting the direction of the airflow S of the mixed air by adjusting the rotation angle of the flow rate distribution portion 90 using the controller 100 is described in more detail.

Figure 7:
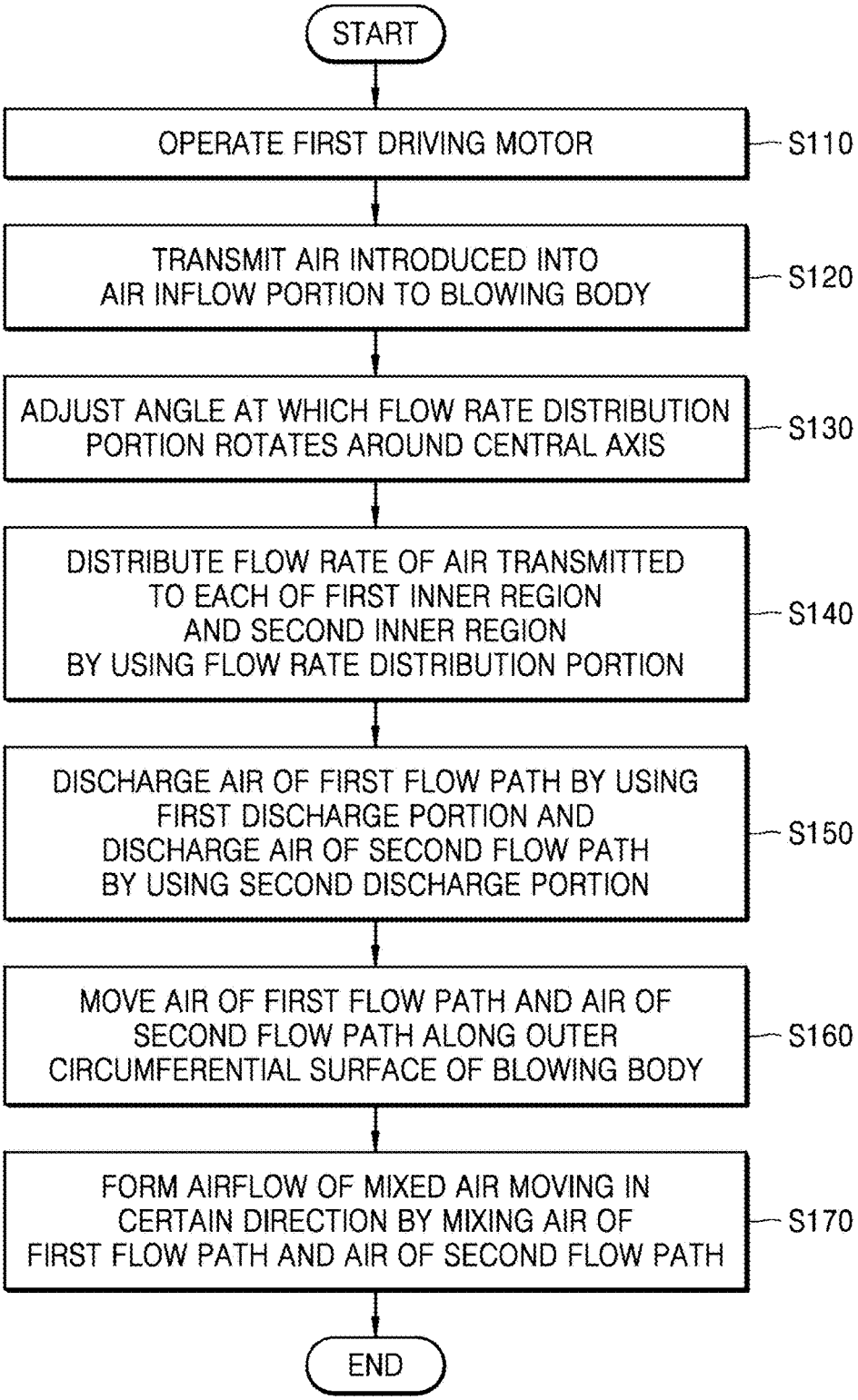
FIG. 7 is a flowchart of an operating method of a blowing device according to an embodiment.
Figure 8A:
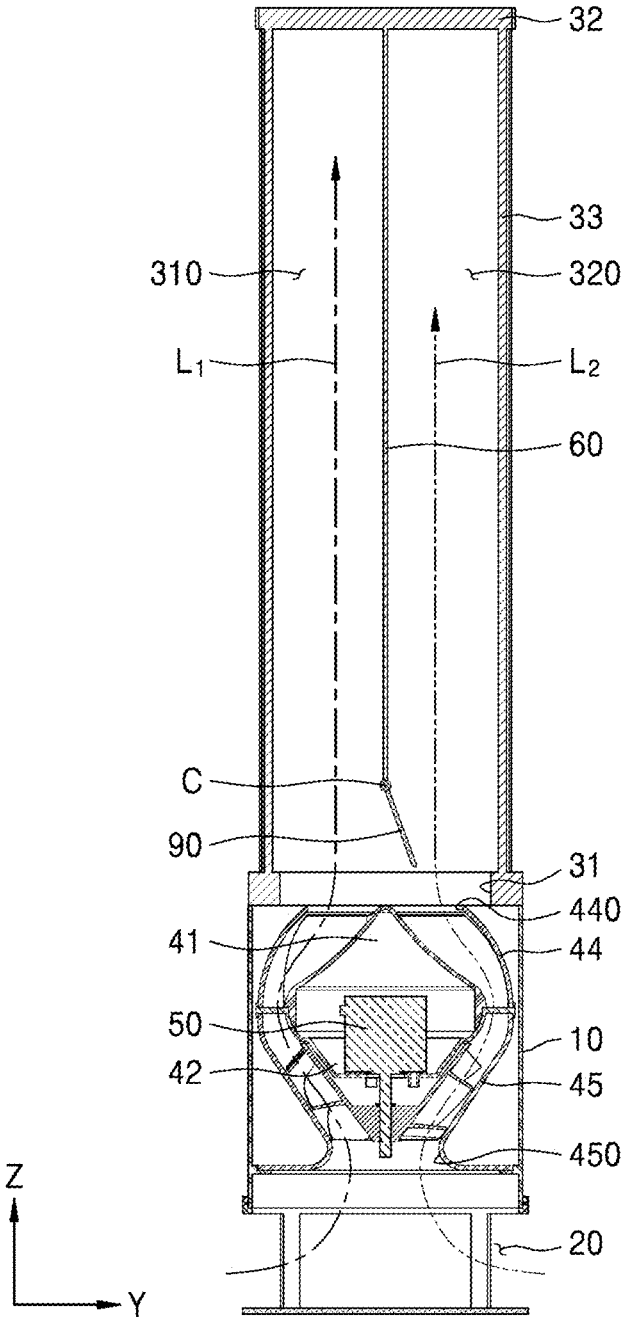
FIG. 8A is a cross-sectional view of the blowing device shown in FIG. 1, taken along the line A-A' of FIG. 1.
Figure 8B:
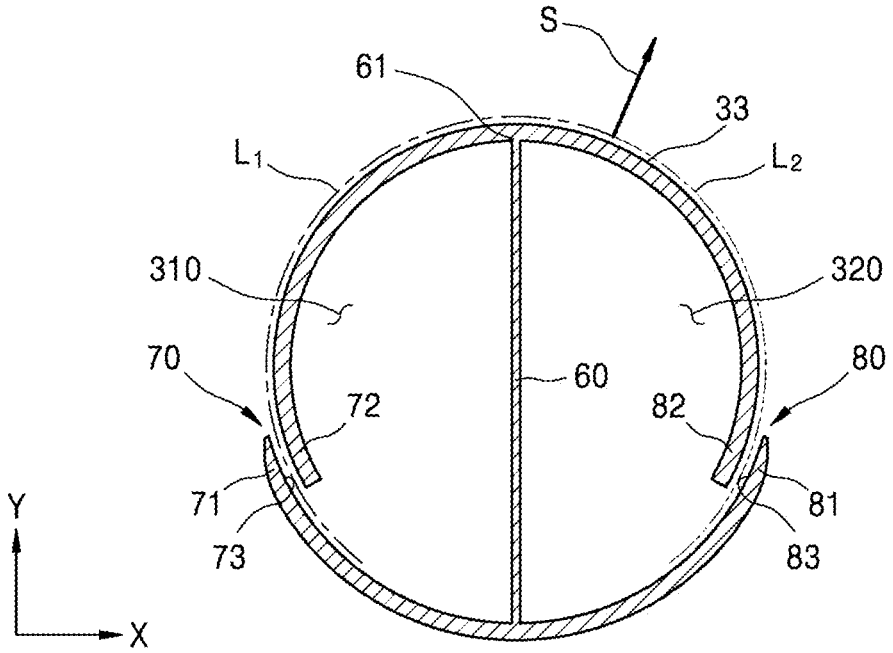
FIG. 8B is a cross-sectional view of the blowing device shown in FIG. 1, taken along the line B-B' of FIG. 1.
Figure 9A:
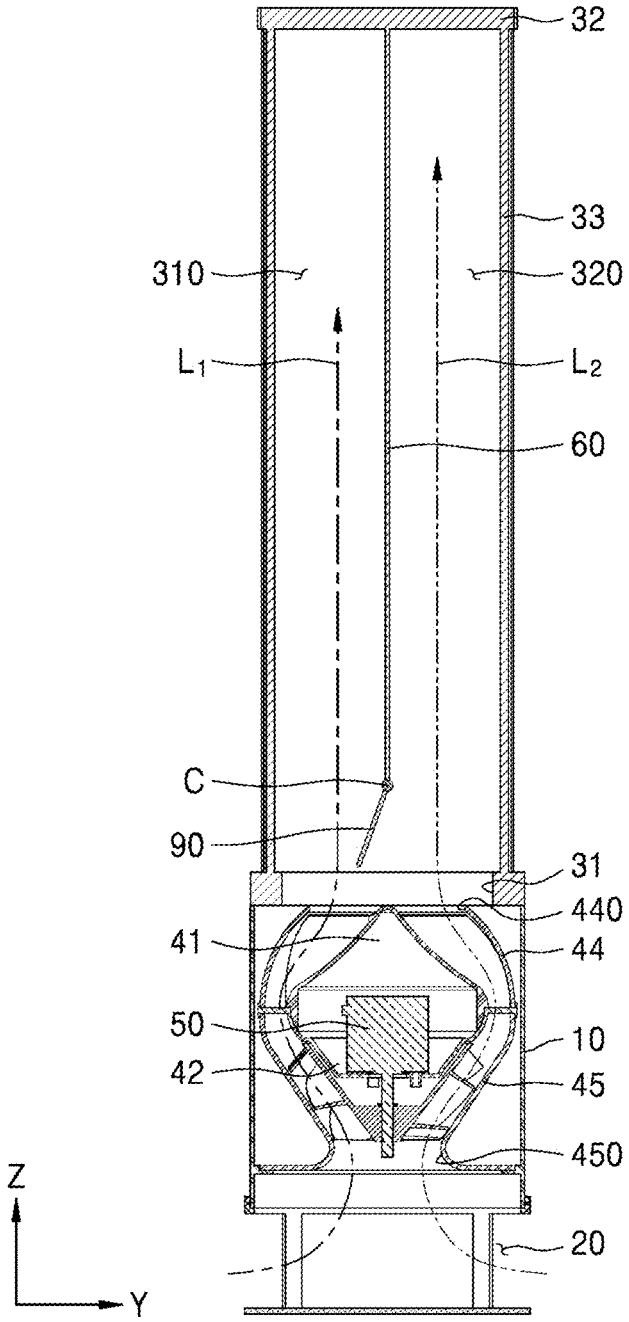
FIG. 9A is a cross-sectional view of the blowing device shown in FIG. 1, taken along the line A-A' of FIG. 1.
Figure 9B:
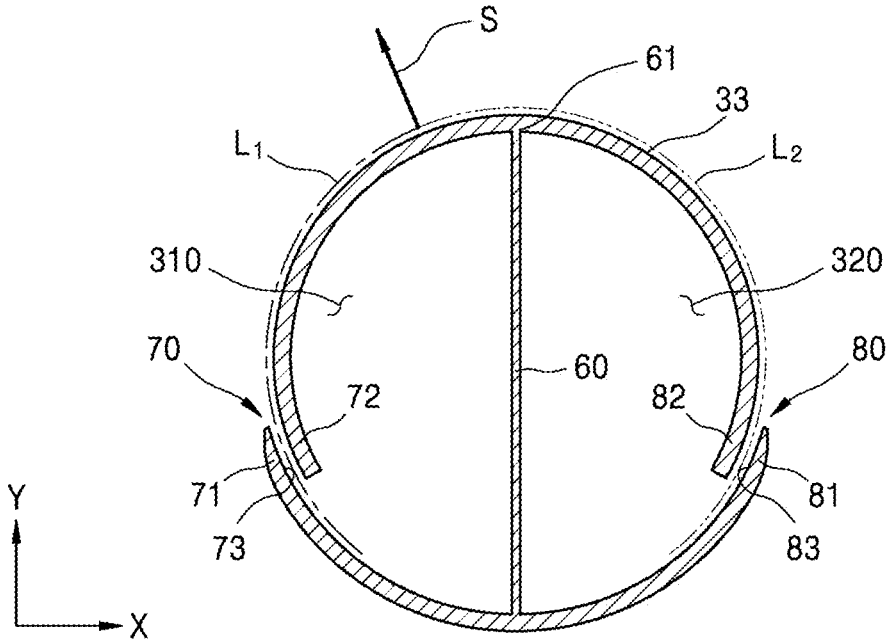
FIG. 9B is a cross-sectional view of the blowing device shown in FIG. 1, taken along the line B-B' of FIG. 1.

FIG. 7 is a flowchart of an operating method of the blowing device according to an embodiment. FIG. 8A is a cross-sectional view of the blowing device shown in FIG. 1, taken along the line A-A'. FIG. 8B is a cross-sectional view of the blowing device shown in FIG. 1, taken along the line B-B'. FIG. 9A is a cross-sectional view of the blowing device shown in FIG. 1, taken along the line A-A'. FIG. 9B is a cross-sectional view of the blowing device shown in FIG. 1, taken along the line B-B'.

Referring to FIG. 7, the operating method of the blowing device according to an embodiment may include an operation of operating the first driving motor 50. (S110) As an example, when a user applies an input signal for use of the blowing device 1, the controller 100 may operate the first driving motor 50. Outside air may be introduced into the blowing device 1 through the air inflow portion 20 by the operation of the first driving motor 50.

Next, the air introduced into the air inflow portion 20 may be transmitted to the blowing body 30. (S120) The air introduced into the air inflow portion 20 by the first driving motor 50 may move in the first direction (Z direction) by passing through the blowing portion 40. The air moved in the first direction (Z direction) may be transmitted to the blowing body 30. Accordingly, a flow path of air leading to the air inflow portion 20, the blowing portion 40, and the blowing body 30 may be formed.

According to an example, fine dust may be collected from the air introduced into the air inflow portion 20, and purified air from which contaminants have been removed may be transferred to the blowing portion 40. For example, one or more of the dust collection portion 110 or the photocatalyst portion 120 may be disposed between the air inflow portion 20 and the blowing portion 40. The dust collection portion 110 or the photocatalyst portion 120 may collect fine dust from the air introduced into the air inflow portion 20 and remove contaminants. The air purified by the dust collection portion 110 or the photocatalyst portion 120 may be transferred to the blowing portion 40. However, the disclosure is not limited thereto, and the flow path of air leading to the air inflow portion 20, the blowing portion 40, and the blowing body 30 may be formed without the dust collection portion 110 or the photocatalyst portion 120.

Next, an angle at which the flow rate distribution portion 90 rotates around the central axis C may be adjusted. (S130) As an example, when the user applies an input signal to adjust a direction of the airflow S of mixed air discharged from the blowing device 1, the controller 100 may operate the second driving motor 95. The flow rate distribution portion 90 may rotate at a certain angle clockwise or a counterclockwise direction around the central axis C, by the operation of the second driving motor 95. For example, the flow rate distribution portion 90 may rotate by 60 degrees or less clockwise and by 60 degrees or less counterclockwise around the central axis C.

According to an example, as shown in FIG. 5, the flow rate distribution portion 90 may be disposed in parallel with the separation wall 60 along the same plane. For example, when the user applies the input signal to adjust the direction of the airflow S of the mixed air discharged from the blowing device 1, the controller 100 may operate the second driving motor 95 to rotate the flow rate distribution portion 90. For example, as shown in FIG. 8A, the flow rate distribution portion 90 may rotate at a certain angle counterclockwise around the central axis C. In addition, as shown in FIG. 9A, the flow rate distribution portion 90 may rotate at a certain angle clockwise around the central axis C.

Next, a flow rate of air transmitted to each of the first inner region 310 and the second inner region 320 may be distributed using the flow rate distribution portion 90. (S140) For example, the flow rate of air transmitted to each of the first inner region 310 and the second inner region 320 of the blowing body 30 may be adjusted according to the rotation angle of the flow rate distribution portion 90. For example, as shown in FIG. 5, when the flow rate distribution portion 90 does not rotate around the central axis C, a flow rate of the first flow path $L_1$ flowing into the first inner region 310 may be substantially the same as a flow rate of the second flow path $L_2$ flowing into the second inner region 320. On the other hand, as shown in FIG. 8A, when the flow rate distribution portion 90 rotates at a certain angle counterclockwise around the central axis C, the flow rate of the first flow path $L_1$ flowing into the first inner region 310 may exceed the flow rate of the second flow path $L_2$ flowing into the second inner region 320. In addition, when the flow rate distribution portion 90 rotates at a certain angle clockwise around the central axis C as shown in FIG. 9A, the flow rate of the first flow path $L_1$ flowing into the first inner region 310 may be smaller than the flow rate of the second flow path $L_2$ flowing into the second inner region 320.

Next, the air in the first flow path $L_1$ may be discharged using the first discharge portion 70, and the air in the second flow path $L_2$ may be discharged using the second discharge portion 80. (S150) For example, the air in the first flow path $L_1$ flowing into the first inner region 310 may be discharged through the first discharge portion 70. In addition, the air in the second flow path $L_2$ introduced into the second inner region 320 may be discharged through the second discharge portion 80.

Next, the air in the first flow path $L_1$ and the air in the second flow path $L_2$ may each move along an outer circumferential surface of the blowing body 30. (S160) For example, the air in the first flow path $L_1$ discharged through the first discharge portion 70 may move along the outer circumferential surface of the blowing body 30. For example, the air of the first flow path $L_1$ discharged through the first release portion 73 included in the first discharge portion 70 may move along the 1-2 outer wall portion 72 provided in a curved shape by the Coanda effect.

In addition, the air of the second flow path $L_2$ discharged through the second discharge portion 80 may move along the outer circumferential surface of the blowing body 30. For example, the air of the second flow path $L_2$ discharged through the second release portion 83 included in the second discharge portion 80 may move along the 2-2 outer wall portion 82 provided in a curved shape by the Coanda effect.

Next, the air of the first flow path $L_1$ and the air of the second flow path $L_2$ may be mixed to form the airflow S of the mixed air moving in a certain direction. (S170) As an example, the air of the first flow path $L_1$ moving along the outer circumferential surface of the blowing body 30 and the air of the second flow path $L_2$ may be mixed to form the airflow S of the mixed air moving in the certain direction. For example, as shown in FIG. 6, when the flow rate of the air in the first flow path $L_1$ and the air in the second flow path $L_2$ are substantially the same, the air in the first flow path $L_1$ discharged from the first discharge portion 70 may move along the outer circumferential surface of the blowing body 30 clockwise. In addition, the air in the second flow path $L_2$ discharged from the second discharge portion 80 may move along the outer circumferential surface of the blowing body 30 counterclockwise. The air of the first flow path $L_1$ and the air of the second flow path $L_2$ may be mixed to form the airflow S of the mixed air moving in the second direction (Y direction).

On the other hand, as shown in FIG. 8B, when the flow rate of the first flow path $L_1$ exceeds the flow rate of the second flow path $L_2$, a point where the air of the first flow path $L_1$ and the air of the second flow path $L_2$ are mixed may be a position inclined at a certain angle clockwise with respect to the second direction (Y direction). Accordingly, the airflow S of the mixed air may be discharged in a direction inclined at a certain angle clockwise with respect to the second direction (Y direction).

In addition, as shown in FIG. 9B, when the flow rate of the first flow path $L_1$ is less than the flow rate of the second flow path $L_2$, the point where the air of the first flow path $L_1$ and the air of the second flow path $L_2$ are mixed may be a position inclined at a certain angle counterclockwise with respect to the second direction (Y direction). Accordingly, the airflow S of the mixed air may be discharged in a direction inclined at a certain angle counterclockwise with respect to the second direction (Y direction).

As described above, the flow rate of the first flow path $L_1$ and the flow rate of the second flow path $L_2$ may be adjusted according to the angle at which the flow rate distribution portion 90 rotates around the central axis C. A discharge direction of the airflow S of the mixed air may be determined based on a difference between the flow rate of the first flow path $L_1$ and the flow rate of the second flow path $L_2$. Accordingly, the discharge direction of the airflow S of the mixed air may be adjusted by adjusting the rotation angle of the flow rate distribution portion 90. Therefore, when the blowing device 1 according to the disclosure is used, the discharge direction of the airflow S of the mixed air may be adjusted without rotating the blowing body 30.

The embodiments of the blowing device and the operating method of the blowing device have been described with reference to the drawings for better understanding, but these are only examples, and it will be understood by those skilled in that art that various modifications and other equivalent embodiments may be made from the embodiments. Accordingly, the true technical protecting range of the disclosure should be determined according to the technical concept of the attached claims.

The invention claimed is:

1. A blowing device comprising:

a base portion having an accommodation space therein;

an air inflow portion disposed on one side of the base portion and through which air is introduced from outside;

a blowing body extending in a first direction, the blowing body comprising:

a lower end defining an opening fluidly communicative with the base portion;

a blocked upper end implemented as a blocking wall; and a side portion extending in the first direction and connecting between the lower end and the blocked upper end, wherein an entirety of the side portion has a cylindrical shape from the lower end to the blocked upper end;

a blowing portion disposed in the base portion and configured to move the air introduced from the air inflow portion to the blowing body;

a first driving motor configured to apply a driving force to the blowing portion;

a separation wall disposed inside the blowing body and extending in the first direction to divide the inside of the blowing body into a first inner region and a second inner region;

a first discharge portion disposed on the side portion of the blowing body and configured to discharge air accommodated in the first inner region to the outside along a first flow path;

a second discharge portion disposed on the side portion of the blowing body and configured to discharge air accommodated in the second inner region to the outside along a second flow path; and a flow rate distribution portion disposed between the blowing portion and the separation wall and comprising a flow rate distributor disposed at a lower end of the separation wall and rotatable around an axis, the flow rate distribution portion being configured to distribute the air moved from the blowing portion to the first inner region and to the second inner region with rotation of the flow rate distributor around the axis adjusting relative amounts of the air moved from the blowing portion to the first inner region and from the blowing portion to the second inner region such that a direction of an airflow of mixed air is determined by a balance of forces of the air along the first flow path and the air along the second flow path, the mixed air is formed by a combination of the air along the first flow path and the air along the second flow path.

2. The blowing device of claim 1, wherein the flow rate distributor comprises a flat plate member extending along a plane and is drivable to be rotatable around the axis.

3. The blowing device of claim 1, wherein:

the first discharge portion comprises a first, first outer wall portion and a first, second outer wall portion spaced apart from each other in a thickness direction of the side portion of the blowing body and a first release portion disposed between the first, first outer wall portion and the first, second outer wall portion, wherein the first release portion has a curvature corresponding to the cylindrical shape of the entirety of the side portion, and the second discharge portion comprises a second, first outer wall portion and a second, second outer wall portion spaced apart from each other in a thickness direction of the side portion of the blowing body and a second release portion disposed between the second, first outer wall portion and the second, second outer wall portion, wherein the second release portion has a curvature corresponding to the cylindrical shape of the entirety of the side portion.

4. The blowing device of claim 1, wherein:

the first discharge portion is disposed at 90 degrees or more and below 180 degrees counterclockwise along an outer circumferential surface of the entirety of the side portion of the blowing body from one side of the separation wall, and the second discharge portion is disposed at 90 degrees or more and less than 180 degrees clockwise along the outer circumferential surface of the entirety of the side portion of the blowing body from the one side of the separation wall.

5. The blowing device of claim 1, wherein:

the blowing portion comprises:

a first blowing fan;

a second blowing fan disposed on upper and lower portions of the blowing portion in the first direction;

a first fan housing; and a second fan housing disposed to surround the first blowing fan and the second blowing fan, the second fan housing comprises a suction hole through which the air introduced from the air inflow portion is introduced in the first direction, and the first fan housing comprises a discharge hole through which the air introduced from the suction hole is discharged in the first direction.

6. The blowing device of claim 1, further comprising:

a dust collection portion disposed between the air inflow portion and the blowing portion; and a photocatalyst portion disposed between the air inflow portion and the blowing portion.

7. An operating method of the blowing device of claim 1, the operating method comprising:

operating the first drive motor;

transmitting the air introduced into the air inflow portion to the blowing body;

distributing a flow rate of the air transmitted to each of the first inner region and the second inner region using the flow rate distribution portion;

adjusting relative amounts of the air transmitted to the first inner region and to the second inner region;

discharging air of a first flow path using the first discharge portion and discharging air of a second flow path using the second discharge portion;

moving the air of the first flow path and the air of the second flow path along the outer circumferential surface of the blowing body; and forming an airflow of mixed air moving in a certain direction by mixing the air of the first flow path and the air of the second flow path, wherein a direction of the airflow of mixed air is determined by a balance of forces of the air along the first flow path and the air along the second flow path.

8. The operating method of claim 7, wherein:

the flow rate distributor comprises a flat plate member extending along a plane.

9. The operating method of claim 8, further comprising:

adjusting an angle at which the flow rate distributor rotates around the axis, wherein:

a flow rate of air transmitted to each of the first inner region and the second inner region changes according to the angle at which the flow rate distributor rotates around the axis.

10. The operating method of claim 7, further comprising:

collecting fine dust from the air introduced into the air inflow portion; and removing contaminants from the air introduced into the air inflow portion using a photocatalyst.

11. The blowing device of claim 1, further comprising:

a dust collector disposed between the air inflow portion and the blowing portion; and a photocatalyst disposed between the air inflow portion and the blowing portion.

12. A blowing device, comprising:

a base;

an air inflow portion aside the base and through which air is introduced;

a body extending in a first direction, being provided as a conduit comprising:

a lower end defining an opening fluidly communicative with the base portion;

a blocked upper end implemented as a blocking wall; and a side portion extending in the first direction and connecting between the lower end and the blocked upper end, wherein an entirety of the side portion has a cylindrical shape from the lower end to the blocked upper end;

a blowing portion drivable to move the air introduced from the air inflow portion to the body;

a separation wall inside the body and extending in the first direction to divide the inside of the body into first and second inner regions;

first and second discharge portions disposed on the side portion of the body and configured to discharge air accommodated in the first and second inner regions along a first flow path and a second flow path, respectively; and a flow rate distributor between the blowing portion and a lower end of the separation wall and rotatable around an axis, the flow rate distributor being configured to distribute the air moved from the blowing portion to the first and second inner regions with rotation of the flow rate distributor around the axis adjusting relative amounts of the air moved from the blowing portion to the first inner region and from the blowing portion to the second inner region such that a direction of an airflow of mixed air is determined by a balance of forces of the air along the first flow path and the air along the second flow path, the mixed air is formed by a combination of the air along the first flow path and the air along the second flow path.

13. The blowing device of claim 12, wherein the flow rate distributor comprises a flat plate member extending along a plane.

14. The blowing device of claim 12, wherein:

the first discharge portion comprises a first, first outer wall portion and a first, second outer wall portion spaced apart from each other in a thickness direction of the side portion of the body and a first release portion disposed between the first, first outer wall portion and the first, second outer wall portion, wherein the first release portion has a curvature corresponding to the cylindrical shape of the entirety of the side portion, and the second discharge portion comprises a second, first outer wall portion and a second, second outer wall portion spaced apart from each other in a thickness direction of the side portion of the body and a second release portion disposed between the second, first outer wall portion and the second, second outer wall portion, wherein the second release portion has a curvature corresponding to the cylindrical shape of the entirety of the side portion.

15. The blowing device of claim 12, wherein:

the first discharge portion is disposed at 90 degrees or more and below 180 degrees counterclockwise along an outer circumferential surface of the entirety of the side portion of the body from one side of the separation wall, and the second discharge portion is disposed at 90 degrees or more and less than 180 degrees clockwise along the outer circumferential surface of the entirety of the side portion of the body from the one side of the separation wall.

16. The blowing device of claim 12, wherein the blowing portion comprises:

a first blowing fan;

a second blowing fan disposed on upper and lower portions of the blowing portion in the first direction;

a first fan housing; and a second fan housing disposed to surround the first blowing fan and the second blowing fan, the second fan housing comprises a suction hole through which the air introduced from the air inflow portion is introduced in the first direction, and the first fan housing comprises a discharge hole through which the air introduced from the suction hole is discharged in the first direction.

17. A blowing device operating method, comprising:

operating a first drive motor;

providing a body having a lower end with an opening and a blocked upper end;

transmitting air introduced into an air inflow portion to first and second inner regions of the body via the opening of the lower end, an entirety of the body having a cylindrical shape from the lower end to the blocked upper end;

distributing a flow rate of the air transmitted to each of the first and second inner regions using a flow rate distributor;

adjusting an angle at which the flow rate distributor rotates to adjust relative amounts of the air transmitted to the first inner region and to the second inner region;

discharging air of a first flow path using a first discharge portion aside the body and configured to discharge air accommodated in the first inner region;

discharging air of a second flow path using a second discharge portion aside the body and configured to discharge air accommodated in the second inner region;

moving the air of the first flow path and the air of the second flow path along an outer circumferential surface of the body; and forming an airflow of mixed air by mixing the air of the first and second flow paths, wherein a direction of the airflow of mixed air is determined by a balance of forces of the air along the first flow path and the air along the second flow path.

18. The blowing device operating method of claim 17, wherein:

the flow rate distributor comprises a flat plate member extending along a plane and is disposed at a lower end of a separation wall separating the first and second inner regions to be rotatable around an axis, a flow rate of air transmitted to each of the first and second inner regions changes according to the angle at which the flow rate distributor rotates around the axis, and a direction of the airflow of the mixed air changes.

* * * * *